US008210274B2

(12) United States Patent
In

(10) Patent No.: US 8,210,274 B2
(45) Date of Patent: Jul. 3, 2012

(54) VIBRATION HAMMER

(75) Inventor: Suk Shin In, Gwangju (KR)

(73) Assignee: Suk Shin In, Gwangju (KR)

( * ) Notice: Subject to any disclaimer, the term of this patent is extended or adjusted under 35 U.S.C. 154(b) by 0 days.

(21) Appl. No.: 12/811,517

(22) PCT Filed: Dec. 31, 2008

(86) PCT No.: PCT/KR2008/007880
§ 371 (c)(1),
(2), (4) Date: Jul. 15, 2010

(87) PCT Pub. No.: WO2009/088176
PCT Pub. Date: Jul. 16, 2009

(65) Prior Publication Data

US 2010/0288521 A1 Nov. 18, 2010

(30) Foreign Application Priority Data

Jan. 7, 2008 (KR) ..... 10-2008-0001925

(51) Int. Cl.
*E21B 1/00* (2006.01)

(52) U.S. Cl. ..... 173/94; 173/105; 173/114

(58) Field of Classification Search ..... 173/90, 173/114, 126, 127, 201
See application file for complete search history.

(56) References Cited

U.S. PATENT DOCUMENTS

| | | | | |
|---|---|---|---|---|
| 2,584,979 | A * | 2/1952 | Bassinger | 173/121 |
| 2,710,740 | A * | 6/1955 | Dempsey | 175/92 |
| 3,044,448 | A * | 7/1962 | Curtis et al. | 173/96 |
| 3,662,843 | A * | 5/1972 | Wise | 173/131 |
| 3,823,786 | A * | 7/1974 | Voitsekhovsky et al. | 173/126 |
| 5,322,139 | A * | 6/1994 | Rose et al. | 175/414 |
| 5,511,626 | A * | 4/1996 | Steen | 175/19 |
| 5,803,188 | A * | 9/1998 | McInnes | 175/92 |
| 6,866,104 | B2 * | 3/2005 | Stoesz et al. | 173/1 |
| 7,617,889 | B2 * | 11/2009 | Beccu | 175/296 |
| 7,677,325 | B2 * | 3/2010 | Shibuya et al. | 173/14 |
| 7,987,930 | B2 * | 8/2011 | Purcell | 175/296 |
| 7,992,652 | B2 * | 8/2011 | Plunkett | 173/13 |
| 8,028,762 | B2 * | 10/2011 | Pillers et al. | 173/210 |
| 2001/0043007 | A1 * | 11/2001 | Jang | 299/69 |
| 2005/0274534 | A1 * | 12/2005 | Goetzfried et al. | 173/201 |

FOREIGN PATENT DOCUMENTS

| | | | |
|---|---|---|---|
| EP | 0058650 | A1 | 5/1982 |
| EP | 0856637 | A1 | 10/1996 |
| KR | 10-0624232 | * | 9/2006 |

* cited by examiner

*Primary Examiner* — Rinaldi Rada
*Assistant Examiner* — Eyamindae Jallow
(74) *Attorney, Agent, or Firm* — Mitchell P. Brook; McKenna Long & Aldridge LLP

(57) ABSTRACT

A vibration hammer is provided, including a main body; a striking unit having a piston housing installed to be elevated by a hydraulic pressure controlling valve unit installed in the main body, a hammer guide slidably installed on the main body to be coaxial with the piston housing, and a piston having both ends fixed to the piston housing and a hammer guide and elastically deformable at a predetermined angle with an elevating direction of the piston housing; and a rotating unit installed in the main body and reciprocally rotating the hammer guide elevated together with the piston. The vibration hammer can prevent the piston from being damaged by being elastically deformed when a lateral pressure applied to the rod connected to the piston.

2 Claims, 4 Drawing Sheets

[Fig. 1]
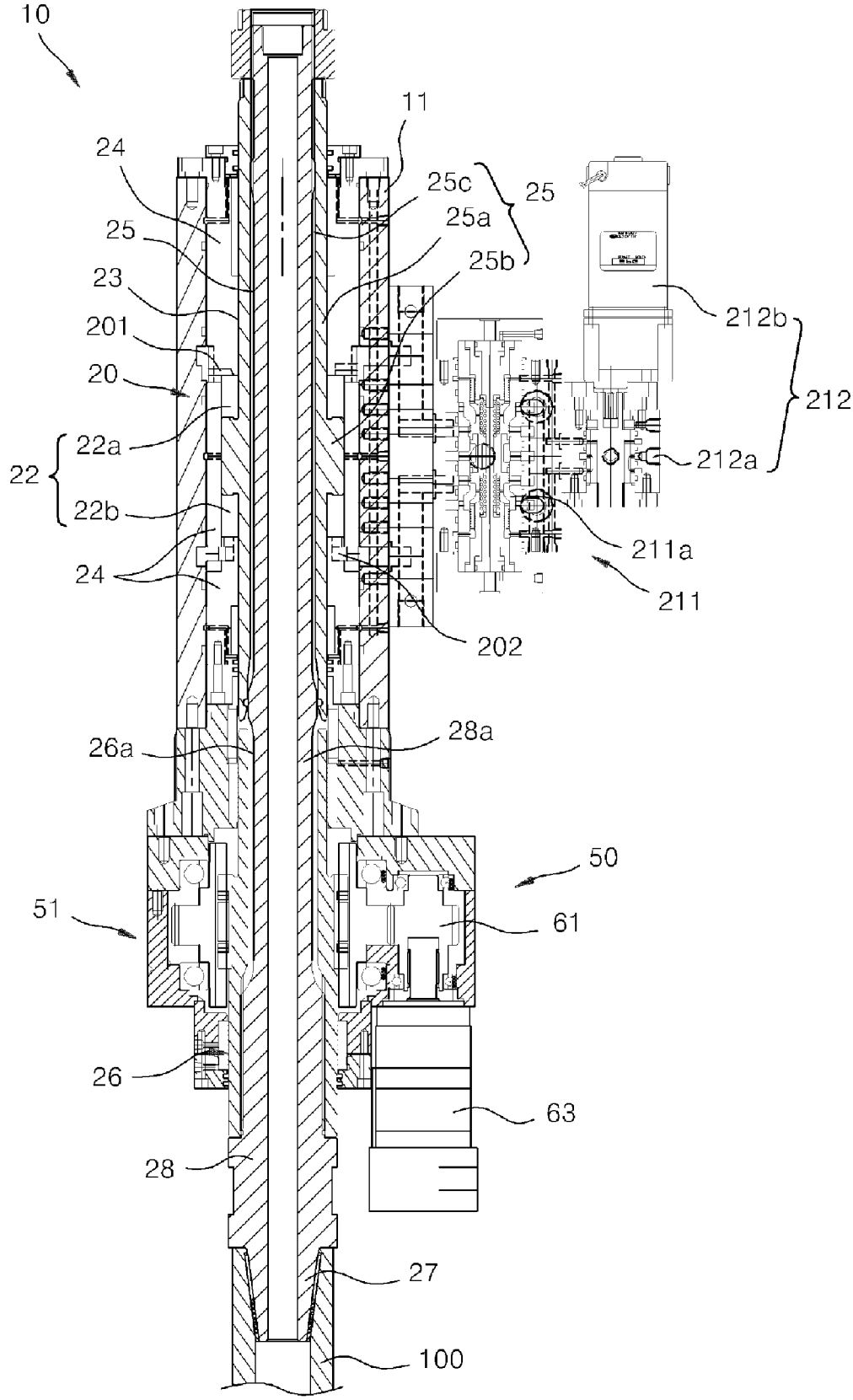

[Fig. 2]
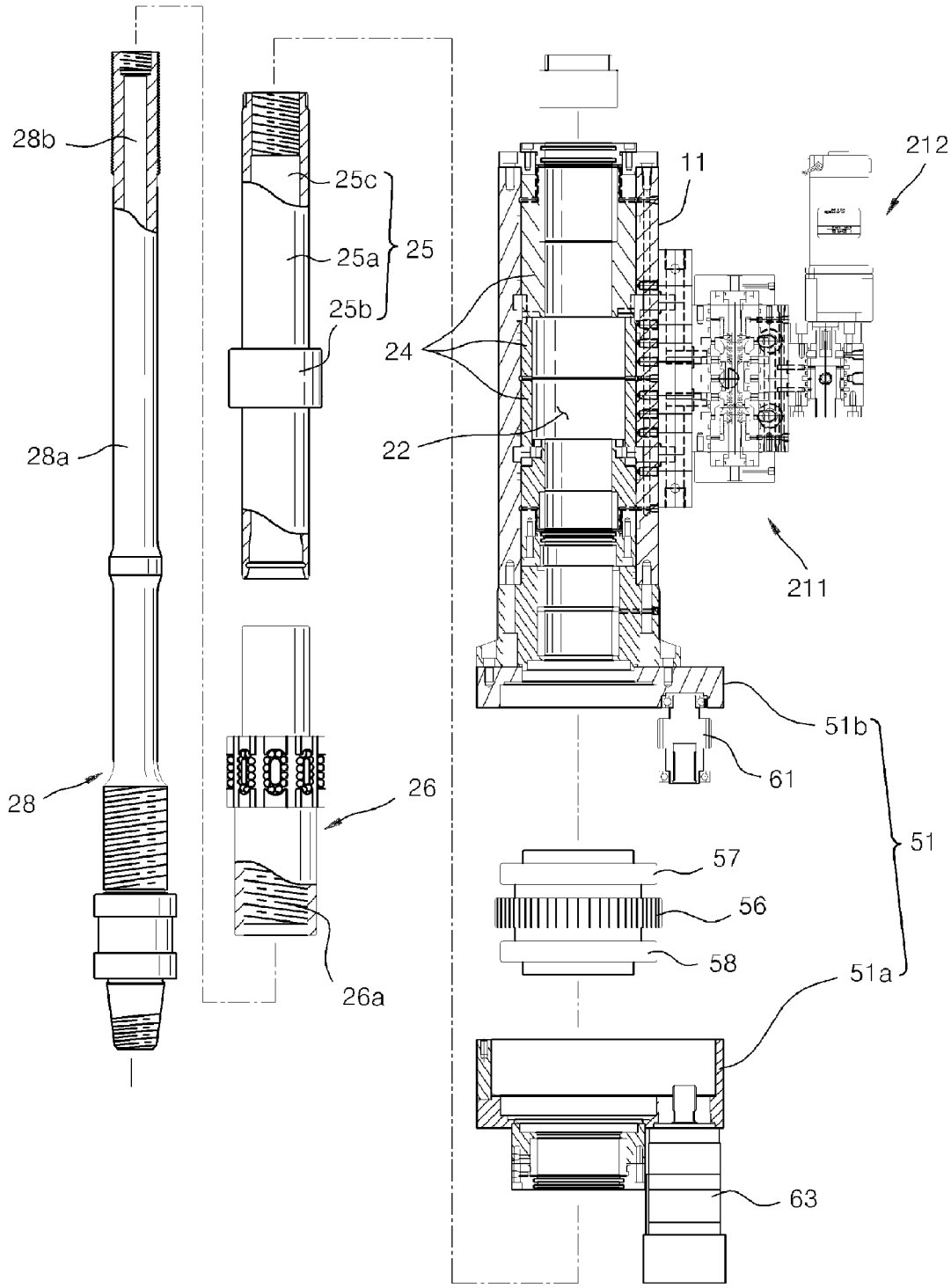

[Fig. 3]
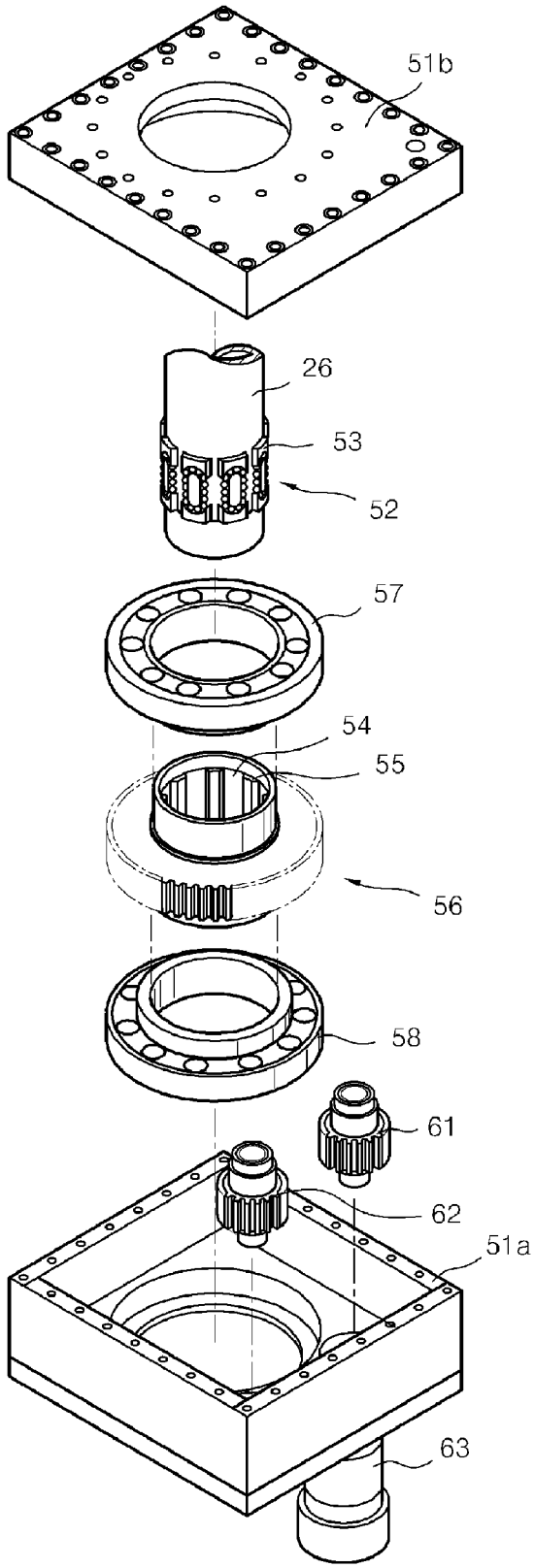

[Fig. 4]
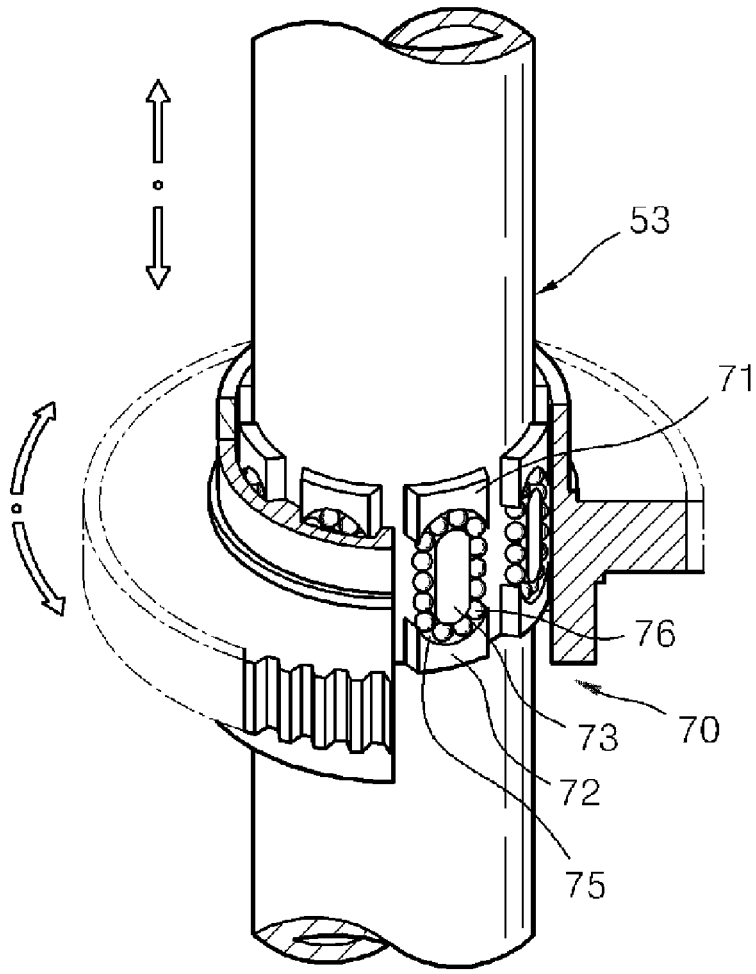
[Fig. 5]
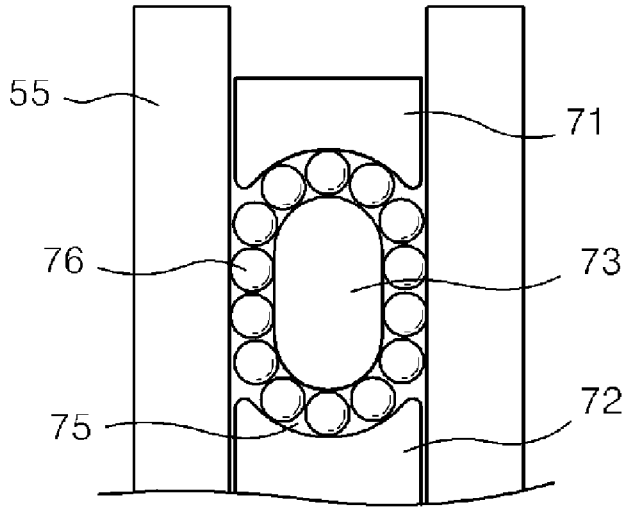

VIBRATION HAMMER

TECHNICAL FIELD

The present invention relates to a boring machine, and more particularly to a vibration hammer which can bore a hole by vibrating or rotating a rod having a bit installed therein.

BACKGROUND ART

A boring machine for perforating the ground is generally based on a technique of simply circulating a bit (Oscillating method), a technique of not only circulating a bit or a ball cutter but also pressurizing the same (Reverse Circulation Drilling method: ROC), and so on.

The oscillation method can cope with a soft ground condition, that is, a boring work is properly carried out through soft ground such as soil. However, for a hard-boring operation, it is necessary to demolish rocks under the ground by dropping a large-sized hammer, requiring additional equipment such as a pile driver.

Meanwhile, in the RCD method, which is an advanced method compared to the oscillation method from the viewpoint of boring capacity, a rock bed is dug such that a soil layer is first dug using an oscillator or a rotator, both a soft rock layer and a hard rock layer are dug by rotating a specially designed bit attached to an end portion of a rod. The RCD method is still poor in boring capacity.

To overcome the foregoing disadvantages, there have been proposed a conventional boring machine constructed to strike and rotate a bit attached to an end portion of a rod during a digging work. The proposed conventional boring machine has a hammer providing a rotational force from an upper portion of the rod and providing a striking force to a lower end of the rod having the bit using air pressure or hydraulic pressure.

In the above-described boring machine, the air pressure or hydraulic pressure is necessarily supplied to the hammer installed at the lower end of the rod having the bit. Thus, as the depth of a bored hole increases, the configuration becomes relatively complicated.

In another conventional boring machine, a vibrator and a bit installed at an end of a rod installed in the vibrator are provided, and the vibrator transfers a rotational force and a striking force to the rod, thereby performing a boring work. The vibrator for applying a shock to the rod includes a device driven by the flow of one or more kinds of hydraulic fluids supplied from a hydraulic supply circuit, and a shock generated from the vibrator is transferred to the rod through a shank. The shank transfers a rotational force derived from a hydraulic motor to the rod.

EP 058,650 and EP 856,637 disclose bonding piston devices in which a hydraulic pressure is supplied from a main supply circuit of a striking device.

DISCLOSURE OF INVENTION

Technical Problem

To solve the above problems, it is an object of the present invention to provide a vibration hammer which can prevent a piston from being damaged by being elastically deformed when a ball guider applied to the rod connected to the piston.

Technical Solution

According to an aspect of the present invention, there is provided a vibration hammer comprising: a main body; a striking unit having a piston housing installed to be elevated by a hydraulic pressure controlling valve unit installed in the main body, a hammer guide slidably installed on the main body to be coaxial with the piston housing, and a piston having both ends fixed to the piston housing and a hammer guide and elastically deformable at a predetermined angle with an elevating direction of the piston housing; and a rotating unit installed in the main body and reciprocally rotating the hammer guide elevated together with the piston.

In the present invention, the rotating unit includes a main gear dampening means-coupled to the hammer guide and reciprocally rotated by a hydraulic motor, and a friction dampening means installed in the dampening means-coupled portion of coupling the main gear and the hammer guide and preventing the main gear and the hammer guide from being fixed to each other due to a frictional heat.

The friction dampening means includes spline units formed by dividing a spline mounted in at least one side of the hammer guide and the main gear in a lengthwise direction, a ball guider mounted between each of the spline units, and rolling balls installed in a ball guide portion between splines provided at both sides coupled to the spline units. The elastically deformable portion between the both ends of the piston supported by the piston housing and the hammer guide has a diameter smaller than that of a hollow portion between the piston housing and the hammer guide.

Advantageous Effects

The vibration hammer can prevent the piston from being damaged by being elastically deformed when a ball guider applied to the rod connected to the piston, improve durability and driving reliability, and prevent the main gear and the hammer guide from being fixed to each other due to a frictional heat while the vibrating piston rotates.

BRIEF DESCRIPTION OF DRAWINGS

FIG. 1 is a cross-sectional view of a vibration hammer according to the present invention;

FIG. 2 is a partially cut-away side view illustrating a connection relationship between a piston housing and a piston;

FIG. 3 is an exploded cross-sectional view of a friction dampening means;

FIG. 4 is a partially cut-away side view of the friction dampening means shown in FIG. 3; and FIG. 5 is an exploded perspective view illustrating essential parts of the friction dampening means shown in FIG. 3.

BEST MODE FOR CARRYING OUT THE INVENTION

A vibration hammer according to the present invention is configured to provide a striking force and a rotating force to a rod guided by a lead standing upright perpendicularly with respect to a machine body and connected to the rod having a boring bit. An exemplary embodiment of the vibration hammer is shown in FIGS. 1 through 3.

Referring to FIGS. 1 through 3, the vibration hammer 10 includes a striking unit 20 installed in a main body 11 and providing a striking force to a rod 100 using a piston 28 connected to a rod 100 for use in boring, a rotating unit 50 installed in the main body 11, supported by a hammer guide 26 to be described later, and reciprocally rotating the hammer guide 26.

The striking unit 20 includes holders 24 installed inside the main body 11 and forming a cylinder portion 22 and a piston housing guide portion 23, and a piston housing 25 supported to the piston housing guide portion 23 and elevated together with the piston housing guide portion 23. The piston housing 25 includes a piston housing support portion 25*a* supported by the piston housing guide portion 23, and a piston portion 25*b* having a diameter larger than that of the piston housing support portion 25*a* and sliding along the cylinder portion 22. The piston housing 25 has a hollow portion 25*c* in its lengthwise direction. Here, the holders 24 may have various members having different diameters coupled to each other. The holder 24 forming the cylinder portion 22 includes first and second ports 201 and 202 for selectively supporting the operating fluids to upper and lower cylinders 22*a* and 22*b* divided by the piston portion 25*b* and provided at the upper and lower portions of the cylinderer portion 22.

The main body 11 includes a hydraulic pressure controlling valve unit 210 for elevating the piston housing 25 by supplying the operating fluids to first and second cylinders 22*a* and 22*b*. The hydraulic pressure controlling valve unit 210 includes a 2-port, 2-position main control valve 211 for alternately feeding and discharging a hydraulic fluid pumped from a hydraulic pump (not shown) to the upper and lower cylinders 22*a* and 22*b* through the first and second ports 201 and 202 formed in the holder 24, and an actuator 212 for changing fluid passages by reciprocating a spool 211*a* of the main control valve 211 in left and right directions. The feeding and discharging of the hydraulic fluid through the first and second ports 201 and 202 may be performed by forming an annular groove on the outer circumferential surface of the main body 11 and forming a plurality of throughholes in the holder 24 corresponding to the annular groove. In order to operate the 2-port, 2-position control valve 211, the actuator 212 allows the operating fluids to be reciprocally transferred by transporting the spool 211*a* using a pilot pressure or rotating a spool of a separate 2-port, 2-position auxiliary control valve 212*a* by means of a hydraulic motor 121*b*.

However, the feeding of the operating fluids to the upper and lower cylinder is not limited to the embodiment illustrated, but can be achieved by any structure as long as it can feed and discharge the operating fluids for elevating the piston portion 25*b* to the first and second ports 201 and 202.

A hammer guide 26 having a hollow portion 26*a* is installed in the main body 11 at a lower portion of the main body 11 so as to slidably move in a lengthwise direction together with the piston housing 25. The piston housing 25 and the hammer guide 26 are spaced apart from each other by a predetermined distance to be installed coaxially with respect to each other.

Meanwhile, the piston 28 having a rod coupling portion 27 formed at its end is coupled to the hollow portions 25*a* and 26*a* of the piston housing 25 and the hammer guide 26. The upper end of the piston 28 is threaded to the piston housing 25, and the lower end of the piston 28 is threaded to the hammer guide 26. An elastic deformable portion 28*a* having a diameter of each of the hollow portions 25*a* and 26*a* of the piston housing 25 and the hammer guide 26 is formed at an unthreaded portion of the piston 28 so as to prevent interference between the piston housing 25 and the hammer guide 26. The lower end of the piston 28 adjacent to the hammer guide 26 supports the elastic deformable portion 28*a* of the piston 28 by a guide ring 29. The guide ring 29 prevents the elastic deformable portion 28*a* from vibrating.

A hollow 28*b* used to supply the operating fluids is formed in the lengthwise direction of the piston 28. The rod coupling portion 27 formed at the end of the piston 28 tapers and has threads formed on its outer circumferential surface.

As shown in FIG. 1 and FIGS. 3 to 5, the rotating unit 50 reciprocally rotates the hammer guide 26 in a state in which elevation of the hammer guide 26 is not affected by the rotating unit 50. A casing 51 is installed at a lower portion of the main body 11, and at least one first spline 52 and a first spline groove 53 are formed on the outer circumferential surface of the hammer guide 26 protruding downward with respect to the casing 51.

A main gear 56 is formed in the casing 51, the main gear 56 having a second spline groove 54 and a second spline 55 respectively coupled to the first spline 52 and the first spline groove 53. The main gear 56 is supported to the casing 51 by means of bearings 57 and 58, and meshes with driving gears 61 and 62 installed in the casing 51. The driving gear 62 is rotated by a hydraulic motor 63. Here, the casing 51 may consist of a casing body 51*a*, and a cover member 51*b* coupled to the casing body 51*a*. The rod coupling portion 27 of the piston 28 coupled to the hammer guide 26 protrudes in the cover member 52*a*.

Meanwhile, a friction dampening means 70 is installed in the spline-coupled portion of coupling the hammer guide 26 and the main gear 56 and prevents the hammer guide 26 and the main gear 56 from being fixed to each other due to a frictional heat when a rotating force derived from the main gear 56 is transmitted to the elevating hammer guide 26.

Referring to FIGS. 3 to 5, the friction dampening means 70 is constructed such that the first spline 52 in the hammer guide 26 is divided into first and second spline units 71 and 72 spaced apart from each other by a predetermined distance, and a ball guider 73 is installed between the first and second spline units 71 and 72, thereby forming a ball guide portion 75 shaped of a closed loop using the second splines 55 positioned at both sides of the main gear 56 coupled to the first spline 52. A plurality of rolling balls 76 are formed in the ball guide portion 75. In order to embody the friction dampening means 70, the first and second spline units 71 and 72 and the ball guider 73 may be formed in the second spline 55 of the main gear 56. In alternative embodiments of the friction dampening means 70, the forming of the friction dampening means 70 may include alternately forming the friction dampening means 70 in the first spline 52 and the second spline 55.

However, the friction dampening means 70 is not limited to the above-described example, but may be embodied by any structure as long as it can dampen the friction applied to the spline-coupled portion of the hammer guide 26 and the main gear 56. In an exemplary embodiment, the friction dampening means 70 may be achieved by forming a ball guider on the outer circumferential surface of first and second splines corresponding to each other in a lengthwise direction and supporting a plurality of rolling balls to a ball guide portion.

The operation of the aforementioned vibration hammer according to the present invention will now be described.

In order to performing a boring work, in a state in which the boring rod 100 is mounted in the rod coupling portion 27 of the vibration hammer 10 supported to a lead, a hydraulic pressure controlling valve unit 200 is operated to selectively supply hydraulic oil to the first and second ports 201 and 202 formed by the main body 11 and the holder 24, thereby elevating the piston housing 25 and the piston 28 coupled thereto. The driving gear 61 is driven by the hydraulic motor 63 installed in the casing 51, thereby rotating the main gear 56 supported to the casing 51 by a bearing.

Accordingly, the boring work is performed by rotating and vertically vibrating the rod 100 coupled to the rod coupling portion 27 of the piston 28 and having a boring bit (not shown) mounted at its end.

During the boring work, a lateral pressure derived from a rock bed or rocks is applied to the rod 100. In this case, since both ends of the piston 28 are supported by the piston housing 25 and the hammer guide 26, the elastically deformable portion 28*a* of the piston 28 is elastically deformed to then absorb the lateral pressure applied to the rod 100. Therefore, it is possible to fundamentally prevent the coupled portion of the rod 100 and the piston 28 from being damaged by the lateral pressure applied to the rod 100. That is to say, when the rod 100 performing the boring work deviates from a perpendicular axis line due to the lateral pressure, the elastically deformable portion 28*a* of the piston 28 is elastically deformed to then absorb the quantity of movement due to the deviation. While the boring work is continuously performed, the rod 100 keeps straight advancing by an elastically restoring capacity of the piston 28.

In addition, while the boring work is continuously performed, a frictional heat is generated at the spline-coupled portion of the main gear 56 and the hammer guide 26 for elevating the hammer guide 26 and rotating the hammer guide 26. Since the spline-coupled portion includes a means for reducing the frictional force, the hammer guide 26 and the main gear 53 can be prevented from being fixed to each other by the frictional force. That is to say, since the first spline 52 is divided into the first and second spline units 71 and 72 and the ball guider 73 for guiding the plurality of rolling balls 76, the frictional force between the first and second splines 52 and 55 can be minimized.

In particular, since the friction dampening means 70 has the ball guide portion 75 shaped of a closed loop, the rolling balls 76 circulate the closed loop, and both lateral surfaces and front surface of the first spline 52 supporting the rolling balls 76 come into contacts with both lateral surfaces of the second spline 55 and the internal surface of the second spline groove 54, respectively, thereby minimizing the frictional force between the first and second splines 52 and 55.

The reduction in the frictional force can fundamentally prevent a hammer member and the main gear 56 for rotating the hammer member from being fixed to each other due to an increased frictional force during a boring work of a deep hole.

As described above, the vibration hammer according to the present invention can provide a rotating force to a rod and provide a sustainable striking force in the lengthwise direction of the rod. Further, the vibration hammer can prevent a loss in the driving power by reducing the frictional force between the hammer member and the main gear, and can prevent the hammer member and the main gear from being fixed to each other. In particular, even if the rod slightly deviates from the perpendicular axis due to a lateral pressure applied to the rod during the boring work, the piston is elastically deformed to absorb the deviation. Accordingly, it is possible to fundamentally prevent the coupled portion of the rod 100 and the piston 28 or the piston 28 from being damaged.

While the present invention has been particularly shown and described with reference to exemplary embodiments thereof, it will be understood by those of ordinary skill in the art that various changes in form and details may be made therein without departing from the spirit and scope of the present invention as defined by the following claims.

It is therefore desired that the present embodiments be considered in all respects as illustrative and not restrictive, reference being made to the appended claims rather than the foregoing description to indicate the scope of the invention.

INDUSTRIAL APPLICABILITY

The vibration hammer according to the present invention can be widely used for various types of boring machines, ground layer samplers, and so on.

The invention claimed is:

1. A vibration hammer comprising:

a main body;

a striking unit having a piston housing installed to be elevated in the upper portion of the main body by a hydraulic pressure controlling valve unit installed in the main body, a hammer guide slidably installed in the lower portion of the main body and to be coaxial with and spaced apart from the piston housing, a piston having both ends fixed to the hollow portion of the piston housing and the hollow portion of the hammer guide respectively and is elastically deformable at a predetermined angle with an elevating direction of the piston housing and a rod installed on the end of the piston and including a boring bit at its end; and a rotating unit installed in the main body and reciprocally rotating the hammer guide elevated together with the piston;

wherein the elastically deformable portion between the both ends of the piston supported by the piston housing and the hammer guide has the outer diameter smaller than the inner diameter of the hollow portion of the piston housing and the hammer guide.

2. The vibration hammer of claim 1, wherein the rotating unit includes a main gear spline-coupled to the hammer guide and reciprocally rotated by a hydraulic motor, and a friction dampening means installed in the spline-coupled portion of coupling the main gear and the hammer guide and preventing the main gear and the hammer guide from being fixed to each other due to a frictional heat.

* * * * *